US008308501B2

(12) United States Patent
Mostoller et al.

(10) Patent No.: US 8,308,501 B2
(45) Date of Patent: Nov. 13, 2012

(54) SOLID STATE LIGHTING ASSEMBLY HAVING A STRAIN RELIEF MEMBER

(75) Inventors: Matthew Edward Mostoller, Hummelstown, PA (US); Christopher George Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/035,513

(22) Filed: Feb. 25, 2011

(65) Prior Publication Data

US 2012/0220161 A1 Aug. 30, 2012

(51) Int. Cl.
*H01R 13/58* (2006.01)

(52) U.S. Cl. ..... 439/457; 439/441; 439/56

(58) Field of Classification Search ..... 439/702–707, 439/441, 56–58, 456–459, 862
See application file for complete search history.

(56) References Cited

U.S. PATENT DOCUMENTS

| | | | | |
|---|---|---|---|---|
| 4,210,380 | A * | 7/1980 | Brzostek | 439/456 |
| 4,389,083 | A * | 6/1983 | Normann et al. | 439/453 |
| 5,883,511 | A * | 3/1999 | Foster | 324/174 |
| 6,010,355 | A * | 1/2000 | Yang | 439/457 |
| 6,109,953 | A * | 8/2000 | Hashigaya et al. | 439/457 |
| 6,116,956 | A * | 9/2000 | Wu | 439/626 |
| 6,128,181 | A * | 10/2000 | Higami et al. | 361/600 |
| 6,988,913 | B2 * | 1/2006 | Zhang | 439/637 |
| 7,179,134 | B2 * | 2/2007 | Harasawa et al. | 439/752 |
| 7,488,196 | B2 * | 2/2009 | Kocher et al. | 439/457 |
| 7,727,003 | B2 * | 6/2010 | Ceroll et al. | 439/447 |
| 7,828,557 | B2 * | 11/2010 | Vogt et al. | 439/56 |
| 2006/0286850 | A1 * | 12/2006 | Yang | 439/457 |
| 2009/0027900 | A1 | 1/2009 | Janos et al. | |
| 2009/0191725 | A1 * | 7/2009 | Vogt et al. | 439/56 |

FOREIGN PATENT DOCUMENTS

| | | | |
|---|---|---|---|
| CA | 2 622 170 | A1 | 9/2008 |
| WO | 2004048846 | A1 | 6/2004 |

OTHER PUBLICATIONS

European Search Report, Mail Date Feb. 7, 2012, EP 12 15 6457, Application No. 12156457.9-2206.

* cited by examiner

*Primary Examiner* — Ross Gushi

(57) ABSTRACT

A solid state lighting assembly includes a housing configured to hold a solid state lighting module. The housing has a cavity. A contact is positioned within the cavity. The contact has a wire end and a mating end. The wire end is configured to be coupled to a insertion segment of a wire. The wire extends from the cavity to an exterior of the housing. A strain relief member extends from the exterior of the housing. The strain relief member is configured to engage a portion of the wire upstream from the insertion segment of the wire.

20 Claims, 6 Drawing Sheets

SOLID STATE LIGHTING ASSEMBLY HAVING A STRAIN RELIEF MEMBER

BACKGROUND OF THE INVENTION

The subject matter described herein relates generally to solid state lighting assemblies.

Solid state lighting assemblies generally include a solid state lighting module having a substrate with a lighting element disposed thereon. For example, the lighting element may be a light emitting diode (LED). The substrate includes contacts pads that are electrically coupled to the lighting element. The contact pads include a positive contact pad and a negative contact pad. The positive contact pad and the negative contact pad are configured to electrically couple to a positive wire and a negative wire, respectively. The positive wire and the negative wire form a circuit through the solid state lighting module to power the lighting element.

However, conventional solid state lighting assemblies are not without their disadvantages. Typically, the wires (positive and negative) are soldered to the contact pads of the substrate. Soldering the wires to the contact pads generally requires special tools, extra materials, and an extra assembly step, which add to the overall cost of assembly. Additionally, soldering, over time and with handling of the components, may subject the assembly to improper electrical connections. Moreover, the soldered wires may be subject to becoming dislodged from the contact pads of the substrate. In particular, forces applied to the wires may disconnect the wires from the contact pad.

A need remains for a solid state lighting assembly that enables quick and tool-less connections between the wires and the contact pads. Another need remains for a solid state lighting assembly that provides strain relief for the wires to prevent the wires from becoming disconnected from the contact pads.

SUMMARY OF THE INVENTION

In one embodiment, a solid state lighting assembly is provided. The assembly includes a housing configured to hold a solid state lighting module. The housing has a cavity. A contact is positioned within the cavity. The contact has a wire end and a mating end. The wire end is configured to be coupled to a insertion segment of a wire. The wire extends from the cavity to an exterior of the housing. A strain relief member extends from the exterior of the housing. The strain relief member is configured to engage a portion of the wire upstream from the insertion segment of the wire.

In another embodiment, a solid state lighting assembly is provided. The assembly includes a housing having a cavity. A contact is positioned within the cavity. The contact has a wire end and a mating end. The wire end is configured to be coupled to a insertion segment of a wire. The wire extends from the cavity to an exterior of the housing. The mating end of the contact has a tip and a mating interface remote from the tip. The tip engages the housing. A solid state lighting module is positioned within the housing. The solid state lighting module has a substrate having a contact pad disposed thereon. The mating interface of the contact engages the contact pad. The contact is flexed between the tip and the mating interface to spring bias the contact against the contact pad.

In another embodiment, a solid state lighting assembly is provided. The assembly includes a housing configured to hold a solid state lighting module. The housing has a cavity having a cavity axis. A contact is positioned within the cavity. The contact has a wire end and a mating end. The wire end of the contact is formed as a poke-in wire connection having a barrel extending axially along the cavity axis and a barb extending into the barrel at an oblique angle with respect to the cavity axis. The barb engages a conductor of an insertion segment of a wire inserted into the barrel in a loading direction. The barb retains the insertion segment of the wire in the barrel in response to forces applied to the wire in a direction opposite to the loading direction. The wire extends from the cavity to an exterior of the housing. A strain relief member extends from the exterior of the housing. The strain relief member is configured to engage a portion of the wire upstream from the insertion segment of the wire.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments described herein include a solid state lighting assembly having a tool-less connection between the wires and the contact pads of a solid state lighting module. The embodiments include a poke-in wire connection that receives wires configured to power a lighting element of the solid state lighting assembly. The poke-in wire connection includes a contact having a wire end that receives the wire and mating end that forms a separable, compressible interface with the contact pads of the solid state lighting module. The wire end of the contact includes a barb that engages the wire to oppose forces that may dislodge the wire from the contact. Additionally, the solid state lighting assembly includes a strain relief member configured to engage the wire. The strain relief member further opposes forces that may dislodge the wire from the contact.

Figure 1:
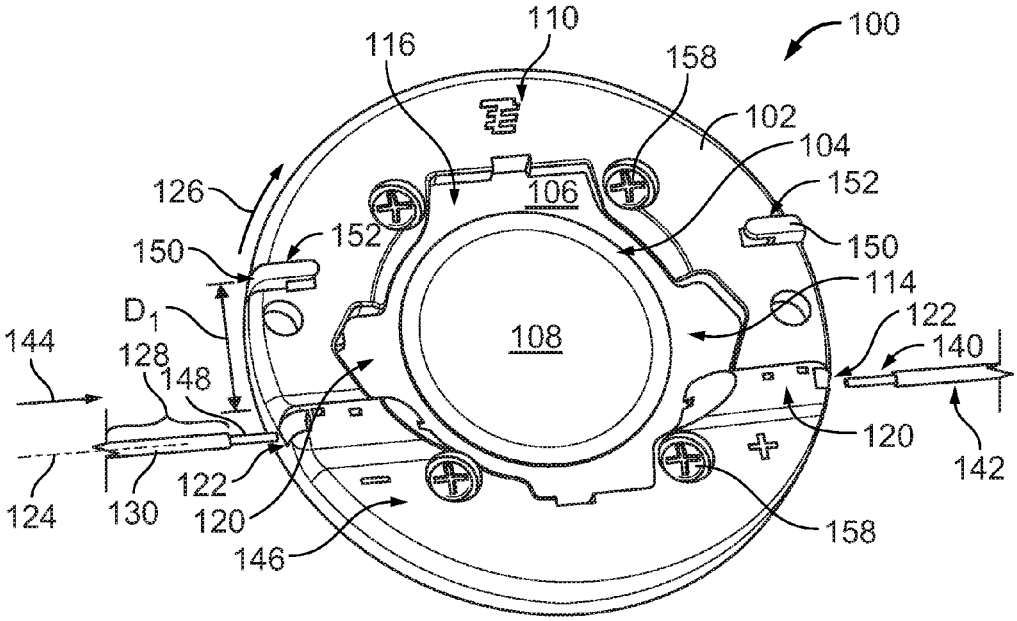
FIG. 1 is a top perspective view of a solid state lighting assembly formed in accordance with an embodiment.

FIG. 1 is a top perspective view of a solid state lighting assembly 100 formed in accordance with an embodiment.

The solid state lighting assembly 100 includes a housing 102 and a solid state lighting module 104. The solid state lighting module 104 includes a substrate 106 having a lighting element 108 disposed thereon. In an exemplary embodiment, the lighting element 108 may be a light emitting diode (LED) or any other suitable solid state lighting element. The housing 102 includes a top 110 and an opposite bottom 112 (shown in FIG. 2). An opening 114 extends through the housing 102 from the top 110 to the bottom 112. The opening 114 is generally centered within the housing 102. Alternatively, the opening 114 may extend through any portion of the housing 102.

Figure 9:
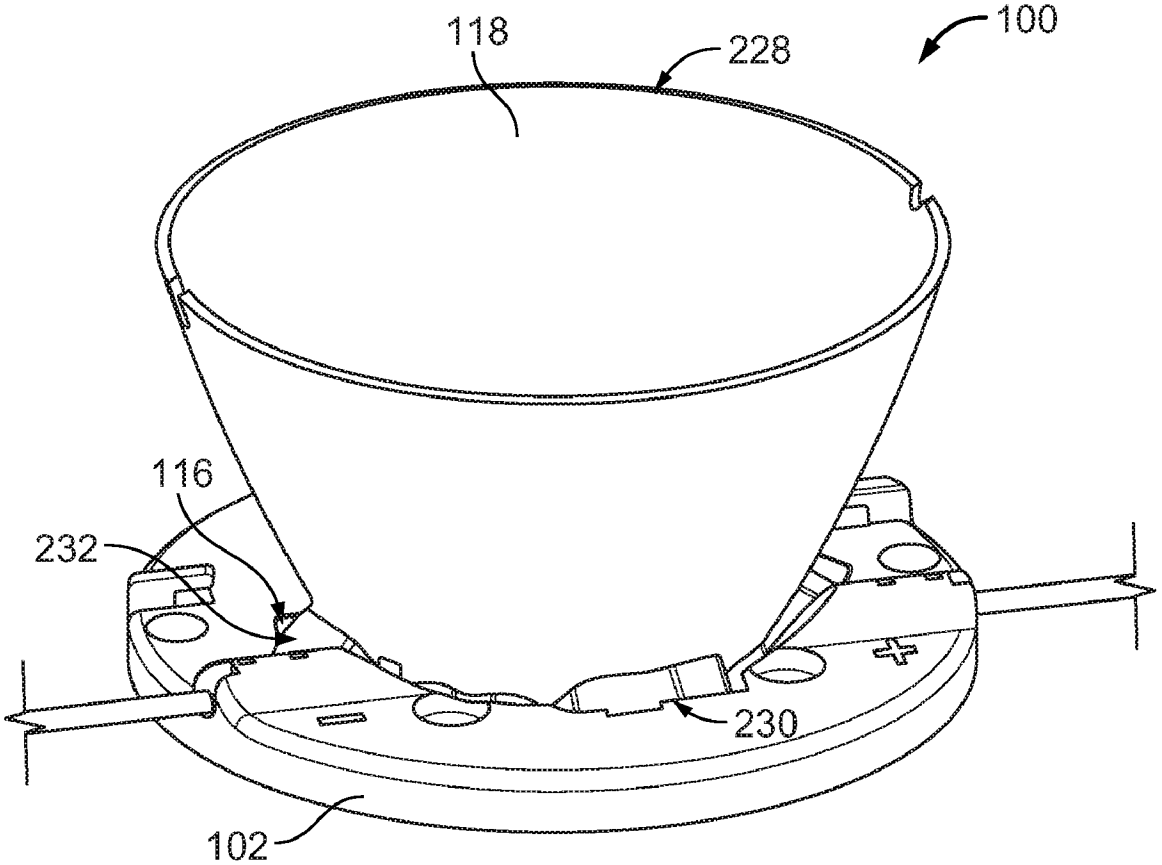
FIG. 9 is a top perspective view of the solid state lighting assembly shown in FIG. 1 and having an optic formed in accordance with an embodiment and coupled thereto.

The substrate 106 of the solid state lighting module 104 is received in the bottom 112 of the housing 102. The substrate 106 is received in the housing 102 such that the lighting element 108 is positioned within the opening 114 of the housing 102. In one embodiment, the lighting element 108 may extend through the opening 114 of the housing 102. The lighting element 108 emits light from the top 110 of the housing 102. In the illustrated embodiment, the housing 102 includes recesses 116 formed around the opening 114. The recesses 116 may be configured to receive an optic 118, as illustrated in FIG. 9. The optic 118 directs the light emitted from the lighting element 108 in a particular lighting pattern.

Cavities 120 are formed in the housing 102. The cavities 120 include an opening 122. The cavities 120 extend from the opening 122 into the housing 102. The cavities 120 extend along a cavity axis 124 from the opening 122 into the housing 102. The openings 122 of the cavities 120 may be formed proximate to an outer perimeter 126 of the housing 102. In alternative embodiments, the openings 122 of the cavities 120 may be formed inward from the perimeter 126 of the housing 102. For example, the openings 122 of the cavities 120 may be formed proximate to the opening 114 of the housing 102. The openings 122 of the cavities 120 face away from the opening 114 of the housing 102. The openings 122 of the cavities 120 may face toward the opening 114 of the housing 102 or at any suitable angle with respect to the opening 114 of the housing in alternative embodiments.

The openings 122 of the cavities 120 are configured to receive a insertion segment 128 of a wire 130 therein. The insertion segment 128 of the wire 130 may include an exposed conductor 148 that is terminated within the cavity 120. The insertion segment 128 of the wire 130 is inserted into the cavity 120 along the cavity axis 124 in a loading direction 144. The wire 130 extends from the cavity 120 to an exterior 146 of the housing 102. The illustrated embodiment includes a positive cavity 120 and a negative cavity 120. The positive cavity 120 receives a positive wire 130 having a positive polarity. The negative cavity 120 receives a negative wire 130 having negative polarity. In the illustrated embodiment, the opening 122 of the positive cavity 120 faces in a different direction than the opening 122 of the negative cavity 120. For example, the opening 122 of the positive cavity 120 is illustrated facing in an opposite direction from the opening 122 of the negative cavity 120. Optionally, the opening 122 of the positive cavity 120 and the opening 122 of the negative cavity 120 may face in other directions, including in the same direction.

In an exemplary embodiment, the wire 130 includes a downstream end 140 and an upstream end 142. The insertion segment 128 of the wire 130 is positioned at the downstream end 140 of the wire 130. The downstream end 140 of the wire 130 is received in the cavity 120. The upstream end 142 of the wire 130 extends from the housing 102 to another component, such as a driver or a power source (not shown).

A strain relief member 150 extends from the exterior 146 of the housing 102. The strain relief member 150 may be coupled to the housing 102. In other embodiments the strain relief member 150 may be formed integrally with the housing 102. The strain relief member 150 is positioned spaced apart from the cavity 120. For example, the strain relief member 150 and the cavity 120 may be spaced apart a distance $D_1$. In the illustrated embodiment, the strain relief member 150 is positioned proximate to the perimeter 126 of the housing 102. The strain relief member 150 may be positioned inward from the perimeter 126 of the housing 102 in alternative embodiments. For example, the strain relief member 150 may be positioned proximate to the opening 114 of the housing 102.

The strain relief member 150 is configured to engage a portion of the wire 130. The strain relief member 150 engages the wire 130 upstream from the insertion segment 128 of the wire 130. The strain relief member 150 provides resistance to forces applied to the wire 130. For example, the strain relief member 150 provides resistance to forces that may tend to disengage the insertion segment 128 of the wire 130 from the cavity 120. The strain relief member 150 may resist forces on the wire 130 in a direction opposite to the loading direction 144 of the wire 130. In the illustrated embodiment, the strain relief member 150 is a hook 152 (as described in more detail with respect to FIG. 6). In other embodiments, the strain relief member 150 may be a series of posts 154 (as described in more detail with respect to FIG. 7) or a single post 156 (as described in more detail with respect to FIG. 8). Alternatively, the strain relief member 150 may be any suitable member for resisting forces on the wire 130.

In the exemplary embodiment, a plurality of screws 158 extend through the housing 102 to secure the housing 102 to a heat sink (not shown).

Figure 2:
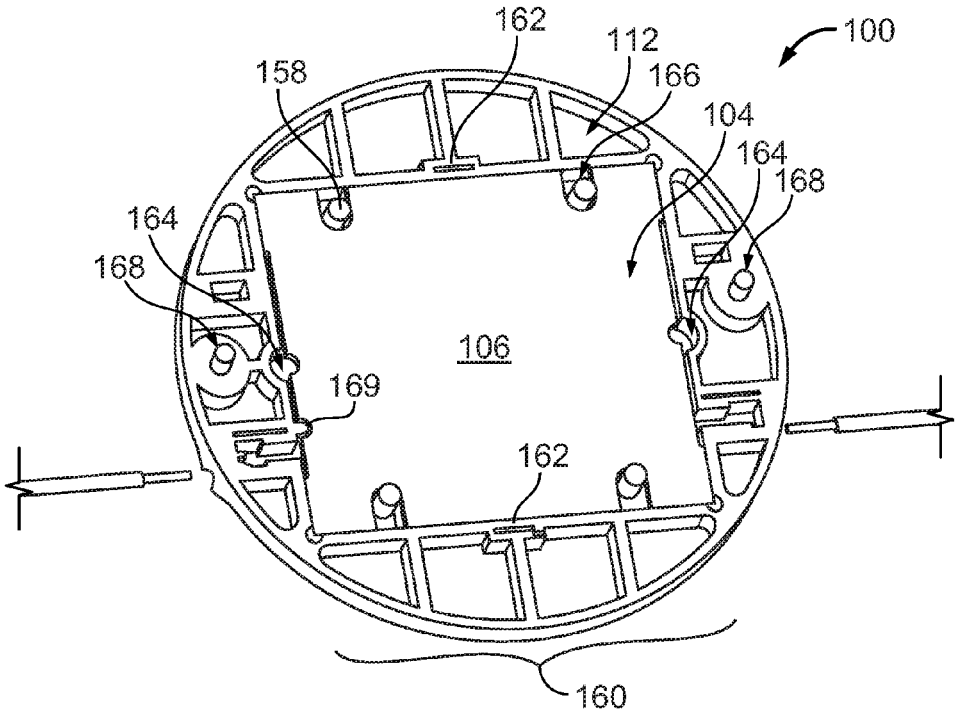
FIG. 2 is a bottom perspective view of the solid state lighting assembly shown in FIG. 1.

FIG. 2 is a bottom perspective view of the solid state lighting assembly 100. The solid state lighting assembly 100 includes a bottom 112. A solid state lighting module receptacle 160 is formed on the bottom 112 of the solid state lighting assembly 100. The receptacle 160 is sized to receive the substrate 106 of the solid state lighting module 104. The solid state lighting module 104 may be press-fit into the receptacle 160. In an exemplary embodiment, the receptacle 160 includes retention mechanisms 162 to create an interference fit with the solid state lighting module 104. Alternatively, the receptacle 160 may include latches, grooves, notches, and/or any other suitable mechanism for securing the solid state lighting module 104 to the housing 102. In one embodiment, the solid state lighting module 104 may be adhered or bonded to the housing 102. Recesses 164 may be formed in the receptacle 160 to enable the solid state lighting module 104 to be removed from the housing 102. In an alternative embodiment, the solid state lighting module 104 may be secured to the heat sink and the housing 102 may be loaded over the solid state lighting module 104.

The screws 158 extend through the bottom 112 of the housing 102. The screws 158 are configured to couple the housing 102 to the heat sink (not shown), such that the solid state lighting module 104 is secured between the heat sink and the housing 102. The screws 158 extend through mounting locations 166 formed in the substrate 106 such that the screws 158 are not secured to the substrate 106. Alternatively, the screws 158 may be secured to the substrate 106. In other embodiments, the housing 102 may include pins, posts, or the like extending therefrom to secure the housing 102 to the heat sink. In the illustrated embodiment, the housing 102 also includes polarization features 169 to provide a keying mechanism for mounting the solid state lighting module 104 within the housing 102. Other polarization features 168 provide an alignment mechanism for mounting the solid state lighting assembly 100 to the heat sink.

Figure 3:
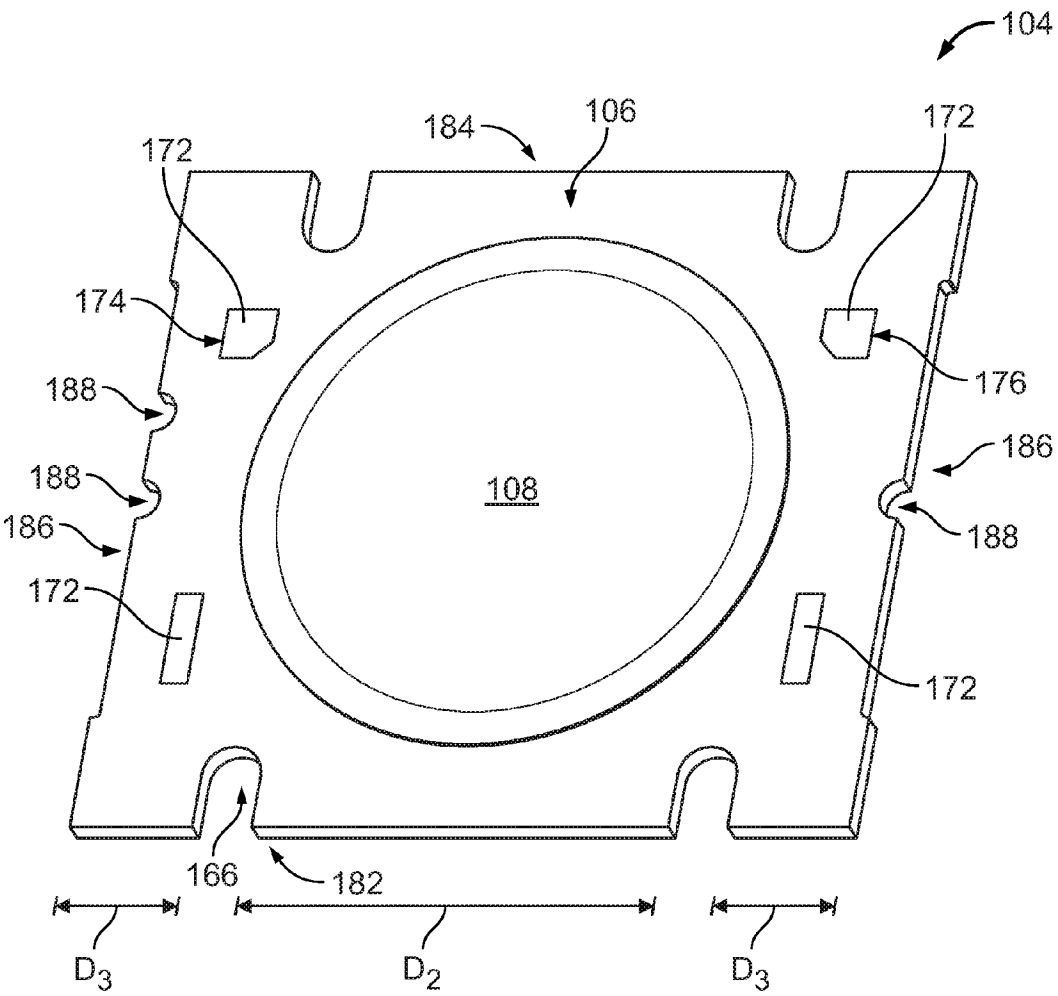
FIG. 3 is a top perspective view of a solid state lighting module formed in accordance with an embodiment.

FIG. 3 is a top perspective view of the solid state lighting module 104. The solid state lighting module 104 includes the substrate 106. The substrate 106 may be a circuit board, for example, a printed circuit board. The lighting element 108 is centered on the substrate 106. Alternatively, the lighting element 108 may be positioned at any suitable location on the substrate 106. As set forth above, the lighting element 108 may be a solid state lighting element, for example, an LED. The substrate 106 may include a single lighting element 108. In alternative embodiments, the substrate 106 may include multiple lighting elements 108. The multiple lighting elements 108 may include different colored lighting elements 108 so that a color of light emitted from the solid state lighting module 104 may be selectively adjusted and/or adjusted in a lighting sequence. In one embodiment, the lighting element 108 may be covered with a lens or the like.

Contact pads 172 are provided on the substrate 106. The contact pads 172 are electrically conductive and configured to receive a power signal. In an exemplary embodiment, the contact pads 172 are configured to electrically couple to the conductor 148 of a wire 130 (both shown in FIG. 1). The contact pads 172 are electrically coupled to the lighting element 108 through a signal trace or the like. The contact pads 172 direct the power signal from a wire 130 to the lighting element 108. The illustrated embodiment includes a positive contact pad 174 and a negative contact pad 176. The positive contact pad 174 is configured to electrically couple to the positive wire 130 (shown in FIG. 1). The negative contact pad 176 is configured to electrically couple to the negative wire 130 (shown in FIG. 1).

The substrate 106 includes a front 182 and a back 184. A pair of sides 186 extends between the front 182 and the back 184. The mounting locations 166 are formed in the front 182 and the back 184 of the substrate 106. Alternatively, the mounting locations 166 may be formed in the sides 186 of the substrate 106. Each of the front 182 and the back 184 of the substrate 106 includes a pair of mounting locations 166 separated by a distance $D_2$. Each of the pair of mounting locations 166 is positioned a distance $D_3$ from the sides 186 of the substrate 106. In other embodiments, each of the front 182 and the back 184 of the substrate 106 may include any number of mounting locations 166 spaced at any distance $D_2$ from each other or distance $D_3$ from the sides 186 of the substrate 106. The screws 158 (shown in FIG. 1) are configured to extend through the mounting locations 166. In one embodiment, the screws 158 may be secured to the substrate 106 at the mounting locations 166.

The sides 186 of the substrate 106 include polarization recesses 188 formed therein. Optionally, polarization recesses 188 may be formed in the front 182 and/or back 184 of the substrate 106. The polarization recesses 188 are configured to receive the polarization features 169 of the housing 102 therethrough.

Figure 4:
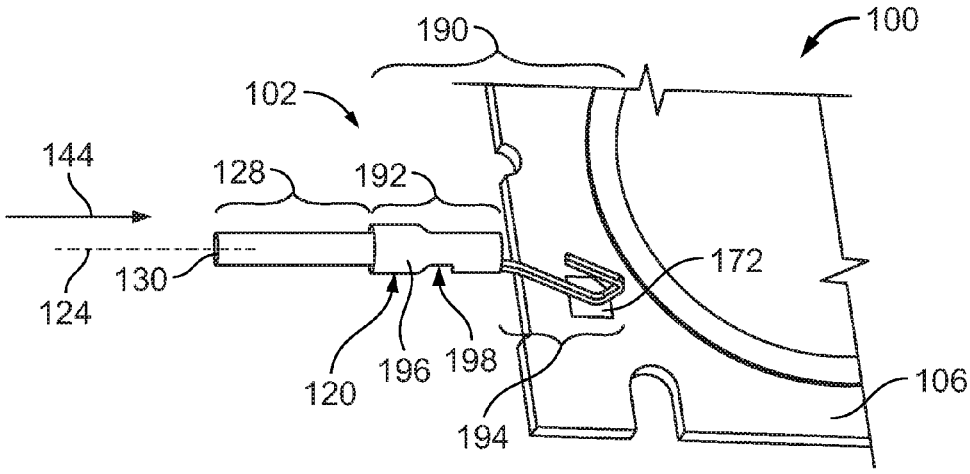
FIG. 4 is a partial top perspective view of the solid state lighting assembly shown in FIG. 1.

FIG. 4 is a partial top perspective view of the solid state lighting assembly 100. The housing 102 of the solid state lighting assembly 100 is illustrated in phantom to show an interior 198 of the cavity 120. A contact 190 is positioned within the cavity 120. In the illustrated embodiment, the contact 190 is a poke-in wire contact configured to receive the conductor 148 of the wire 130. The contact 190 may be an insulation displacement connector, a crimp connector, or the like in alternative embodiments. In the illustrated embodiment, the contact 190 includes a wire end 192 and a mating end 194. The mating end 194 of the contact 190 forms a separable, compressible interface with the contact pad 172 of the substrate 106.

The wire end 192 of the contact 190 includes a barrel 196 that receives the conductor 148 of the wire 130. The barrel 196 extends through the cavity 120 along the cavity axis 124. The conductor 148 of the wire 130 is inserted into the barrel 196 in the loading direction 144.

Figure 5:
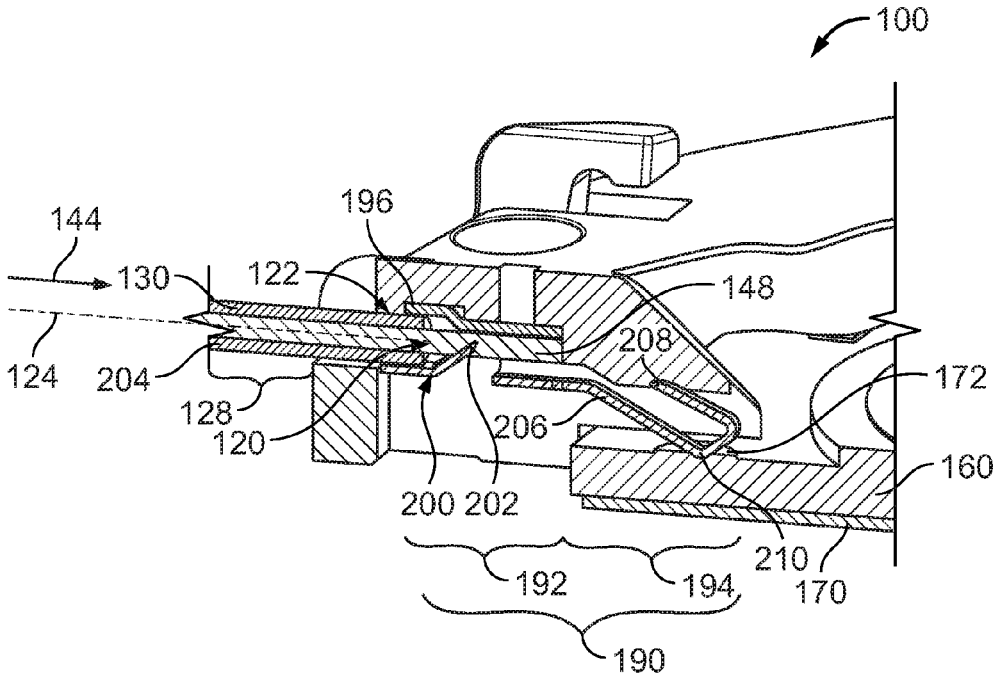
FIG. 5 is a partial cut-away view of the solid state lighting assembly shown in FIG. 1.

FIG. 5 is a partial cut-away view of the solid state lighting assembly 100. The wire end 192 of the contact 190 includes the barrel 196 and a barb 200. The barrel 196 extends from the opening 122 of the cavity 120 into the cavity 120 along the cavity axis 124. The barb 200 extends at an oblique angle with respect to the cavity axis 124. As used herein, the term "oblique angle" is defined as any angle that diverges from a straight line. An "oblique angle" may be an acute angle, an obtuse angle, or a right angle. The barb 200 extends inward from the barrel 196 in the direction of the loading direction 144. When the insertion segment 128 of the wire 130 is inserted into the barrel 196, a tip 202 of the barb 200 engages the wire 130. In one embodiment, the tip 202 of the barb 200 engages the conductor 148 of the wire 130. The barb 200 retains the wire 130 in the barrel 196. The barb 200 is configured to oppose forces applied to the wire 130 in a direction opposite to the loading direction 144 of the wire 130.

The conductor 148 of the wire 130 engages the wire end 192 of the contact 190. The mating end 194 of the contact 190 extends from the wire end 192 of the contact 190 such that power signals from the wire 130 are directed to the mating end 194 of the contact 190. In the illustrated embodiment, the mating end 194 of the contact 190 extends from the barrel 196. The mating end 194 of the contact 190 is configured as a simply supported beam. The mating end 194 of the contact 190 includes a transition member 206 that is joined to the wire end 192 of the contact 190. A tip 208 of the mating end 194 of the contact 190 abuts the housing 102. A mating interface 210 of the mating end 194 of the contact 190 extends between the tip 208 and the transition member 206.

The mating interface 210 is configured to engage the contact pad 172 of the substrate 106. The mating interface 210 forms separable, compressible interface with the contact pad 172 of the substrate 106. The contact 190 is flexed between the tip 208 of the mating end 194 and the mating interface 210 to spring bias the contact 190 against the contact pad 172.

In the illustrated embodiment, the thermal interface 170 is provided on the substrate 106. The thermal interface 170 may be any suitable thermal interface, for example conductive grease, for mounting the substrate 106 to a heat sink (not shown).

Figure 6:
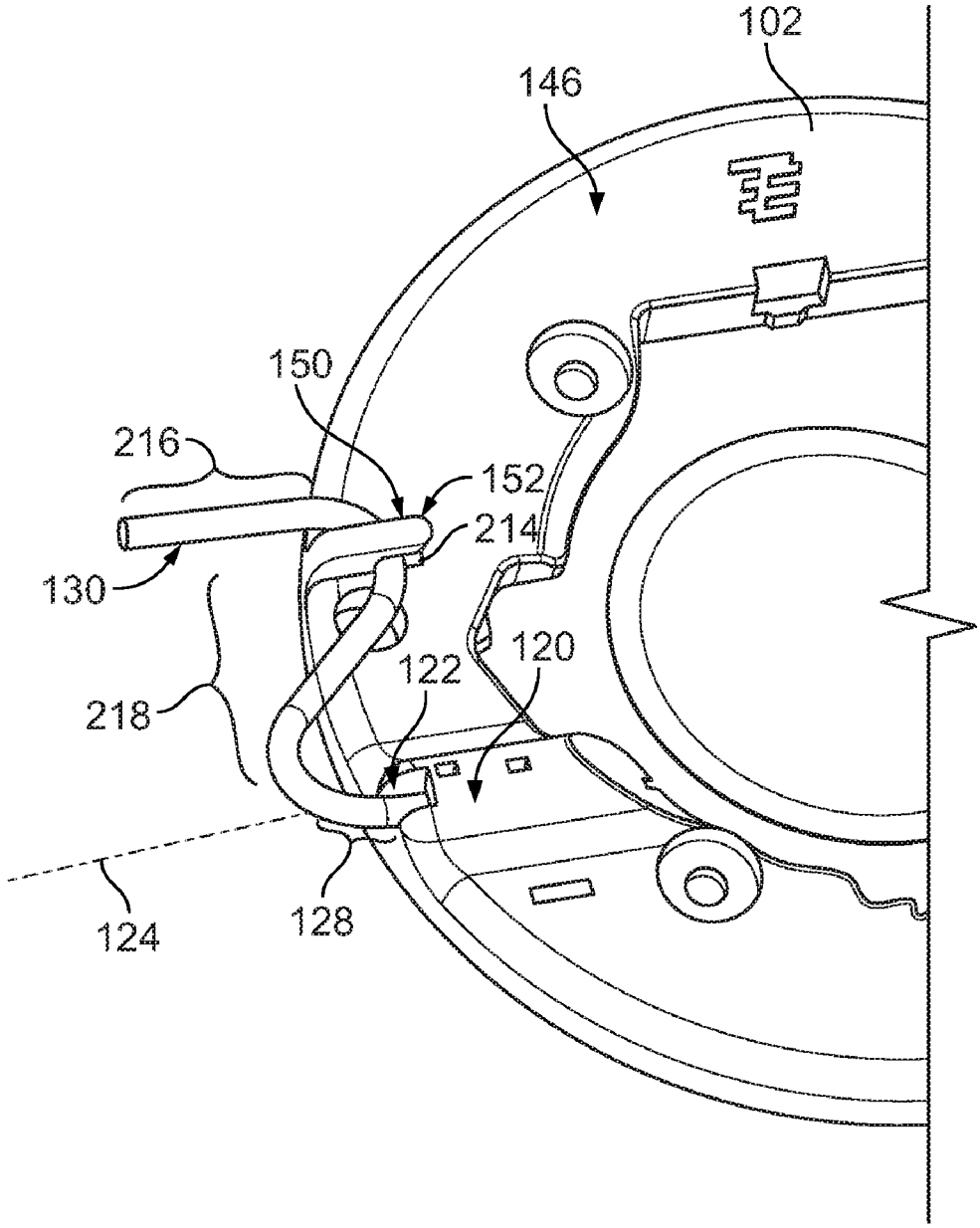
FIG. 6 is a top perspective view of a strain relief member formed in accordance with an embodiment.

FIG. 6 is a top perspective view of a strain relief member 150 formed in accordance with an embodiment and having the wire 130 coupled thereto. FIG. 6 illustrates the strain relief member 150 as a hook 152. The hook 152 is provided on the exterior 146 of the housing 102. The hook 152 may be coupled to the housing 102 or formed integrally therewith. The hook 152 includes a slot 214 to engage the wire 130 upstream from the insertion segment 128 of the wire 130. The wire 130 at least partially extends around the hook 152. The slot 214 may be sized to form an interference fit with the wire 130. In the illustrated embodiment, the slot 214 faces in a different direction than the opening 122 of the cavity 120. The slot 214 faces in an opposite direction from the opening 122 of the cavity 120. Optionally, the slot 214 and the opening 122 of the cavity 120 may face in the same direction.

The wire 130 includes the insertion segment 128 extending from the cavity 120 to the exterior 146 of the housing 102. The insertion segment 128 generally extends along the cavity axis 124 of the cavity 120. A main segment 216 of the wire extends from the hook 152 to a power source (not shown). An intermediate segment 218 of the wire 130 extends between the main segment 216 of the wire 130 and the insertion segment 128 of the wire 130. The hook 152 engages the wire 130 such that the intermediate segment 218 of the wire 130 extends at an oblique angle with respect to the cavity axis 124. The hook 152 engages the wire 130 such that the main segment 216 of the wire 130 extends at an oblique angle with respect to the intermediate segment 218 of the wire 130. The main segment 216 of the wire 130 may extend from the hook 152 parallel to the cavity axis 124. Optionally, the main segment 216 of the wire 130 may extend from the hook 152 at an oblique angle with respect to the cavity axis 124.

Figure 7:
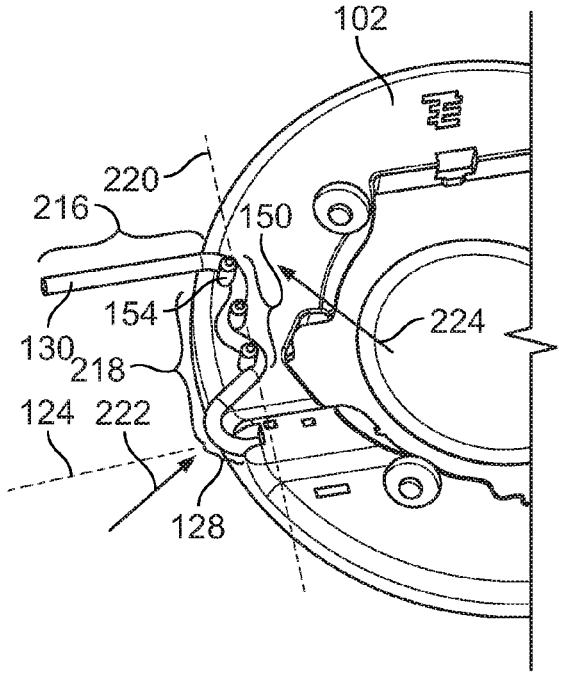
FIG. 7 is a top perspective view of a strain relief member formed in accordance with another embodiment.

FIG. 7 is a top perspective view of a strain relief member 150 formed in accordance with an embodiment and having the wire 130 coupled thereto. FIG. 7 illustrates the strain relief member 150 as a series of posts 154. The posts 154 extend along a line 220. The illustrated embodiment includes three posts 154. Alternative embodiments may include any number of posts 154. The intermediate segment 218 of the wire 130 is threaded through the posts 154 such that intermediate segment 218 of the wire 130 changes directions at each post 154. For example, the intermediate segment 218 of the wire 130 travels in a first direction 222 to a first post 154 and travels in a second direction 224 from the first post 154 to a second post 154. The intermediate segment 218 of the wire 130 at least partially wraps around each post 154. Optionally, the intermediate segment 218 of the wire 130 may be entirely wrapped around each post 154 one or more times.

In one embodiment, the posts 154 may include a flange (not shown) extending from the top thereof. The intermediate segment 218 of the wire 130 may be held between the housing 102 and the flange. The flange may form an interference fit with the wire 130. In another embodiment, the posts 154 may include grooves extending therearound to receive and position the intermediate segment 218 of the wire 130 with respect to the post 154.

The posts 154 engage the wire 130 such that the intermediate segment 218 of the wire 130 extends at an oblique angle with respect to the cavity axis 124. The posts 154 engage the wire 130 such that the main segment 216 of the wire 130 extends at an oblique angle with respect to the intermediate segment 218 of the wire 130. The main segment 216 of the wire 130 may extend from the last post 154 parallel to the cavity axis 124. Optionally, the main segment 216 of the wire 130 may extend from the last post 154 at an oblique angle with respect to the cavity axis 124.

Figure 8:
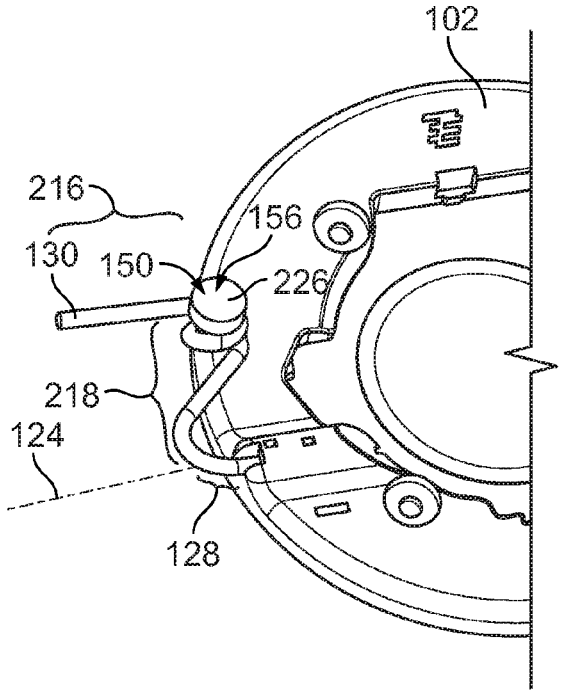
FIG. 8 is a top perspective view of a strain relief member formed in accordance with another embodiment.

FIG. 8 is a top perspective view of a strain relief member 150 formed in accordance with an embodiment and having the wire 130 coupled thereto. FIG. 8 illustrates the strain relief member 150 as a post 156. The post 156 may be integrally formed with the housing 102. Alternatively, the post 156, may be a screw, pin, or the like that is inserted into the housing 102. The wire 130 is configured to wrap at least partially around the post 156. Optionally, the wire 130 may be wrapped entirely around the post 156 one or more times.

In the illustrated embodiment, the post 156 includes a flange 226 extending from the top thereof. The intermediate segment 218 of the wire 130 may be held between the housing 102 and the flange 226. The flange 226 may form an interference fit with the wire 130. In another embodiment, the post 156 may include grooves extending therearound to receive and position the intermediate segment 218 of the wire 130 with respect to the post 156.

The post 156 engages the wire 130 such that the intermediate segment 218 of the wire 130 extends at an oblique angle with respect to the cavity axis 124. The post 156 engages the wire 130 such that the main segment 216 of the wire 130 extends at an oblique angle with respect to the intermediate segment 218 of the wire 130. The main segment 216 of the wire 130 may extend from the post 156 parallel to the cavity axis 124. Optionally, the main segment 216 of the wire 130 may extend from the post 156 at an oblique angle with respect to the cavity axis 124.

FIG. 9 is a top perspective view of the solid state lighting assembly 100 having an optic 118 coupled thereto. The optic 118 includes a top 228 and a bottom 230. The bottom 230 of the optic 118 is coupled to the housing 102 of the solid state lighting assembly 100. The bottom 230 of the optic 118 includes protrusions 232 extending therefrom. The protrusions 232 are received in the recesses 116 of the housing 102. The protrusions 232 may be press-fit into the recesses 116 and/or retained within the recesses 116 through an interference fit. In one embodiment, the housing 102 may include a latch, detent, or the like to retain the optic 118. Optionally, the optic 118 may be adhered or bonded to the housing 102 or substrate 106.

The optic 118 has a conical shape and extends outward from the bottom 230 of the optic 118 to the top 228 of the optic 118. The optic 118 is configured to direct and/or focus light emitted from the solid state lighting assembly 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A solid state lighting assembly comprising:

a housing configured to hold a solid state lighting module, the housing having a cavity;

a contact positioned within the cavity, the contact having a wire end and a mating end, the wire end configured to be coupled to an insertion segment of a wire, the wire extending from the cavity to an exterior of the housing, the mating end of the contact having a tip and a mating interface remote from the tip, the tip engaging the housing, the mating end of the contact including a transition member joined to the wire end of the contact, the mating interface of the mating end of the contact extending along the contact between the tip and the transition member; and a strain relief member extending from the exterior of the housing, the strain relief member configured to engage a portion of the wire upstream from the insertion segment of the wire.

2. The solid state lighting assembly of claim 1, wherein the cavity extends along a cavity axis, the insertion segment of the wire extending along the cavity axis to the contact, the strain relief member being positioned spaced apart from the cavity such that an intermediate segment of the wire extends between the cavity and the strain relief member at an oblique angle with respect to the cavity axis.

3. The solid state lighting assembly of claim 1, wherein an intermediate segment of the wire extends between the insertion segment of the wire and a main segment of the wire, the strain relief member holding the wire such that the main segment of the wire extends from the intermediate segment of the wire at an oblique angle.

4. The solid state lighting assembly of claim 1, wherein the strain relief member is a hook that receives the wire such that the wire wraps at least partially around the hook.

5. The solid state lighting assembly of claim 4, wherein the hook includes a slot to receive the wire and the cavity includes an opening to receive the insertion segment of the wire, the opening of the cavity and the slot of the hook facing in different directions.

6. The solid state lighting assembly of claim 1, wherein the strain relief member is a post, the wire being wrapped at least one time around the post.

7. The solid state lighting assembly of claim 1, wherein the strain relief member includes a series of posts, the wire being threaded through the series of posts such that the wire changes directions between each post.

8. The solid state lighting assembly of claim 1, wherein the contact is configured to be terminated to the insertion segment of the wire by one of a poke-in contact, insulation displacement connectors, or a crimp connection.

9. A solid state lighting assembly comprising:

a housing having a cavity;

a contact positioned within the cavity, the contact having a wire end and a mating end, the wire end configured to be coupled to an insertion segment of a wire, the wire extending from the cavity to an exterior of the housing, the mating end of the contact having a tip and a mating interface remote from the tip, the tip engaging the housing, the mating end of the contact including a transition member joined to the wire end of the contact, the mating interface of the mating end of the contact extending along the contact between the tip and the transition member; and a solid state lighting module positioned within the housing, the solid state lighting module having a substrate having a contact pad disposed thereon, the mating interface of the contact engaging the contact pad, the contact being flexed between the tip and the mating interface to spring bias the contact against the contact pad.

10. The solid state lighting assembly of claim 9, wherein the mating end of the contact is a simply supported beam.

11. The solid state lighting assembly of claim 9, wherein the solid state lighting module is retained in the housing through an interference fit.

12. The solid state lighting assembly of claim 9, wherein the contact is configured to be terminated to the insertion segment of the wire by one of a poke-in contact, insulation displacement connectors, or a crimp connection.

13. The solid state lighting assembly of claim 9 further comprising a strain relief member extending from the exterior of the housing, the cavity extending along a cavity axis, the insertion segment of the wire extending along the cavity axis to the contact, the strain relief member being positioned spaced apart from the cavity such that an intermediate segment of the wire extends between the cavity and the strain relief member at an oblique angle with respect to the cavity axis.

14. The solid state lighting assembly of claim 9 further comprising a strain relief member extending from the exterior of the housing, wherein an intermediate segment of the wire extends between the insertion segment of the wire and a main segment of the wire, the strain relief member holding the wire such that the main segment of the wire extends from the intermediate segment of the wire at an oblique angle.

15. A solid state lighting assembly comprising:

a housing configured to hold a solid state lighting module, the housing having a cavity having a cavity axis;

a contact positioned within the cavity, the contact having a wire end and a mating end, the wire end of the contact being formed as a poke-in wire contact having a barrel extending axially along the cavity axis and a barb extending into the barrel at an oblique angle with respect to the cavity axis, the barb engaging a conductor of an insertion segment of a wire inserted into the barrel in a loading direction, the barb retaining the insertion segment of the wire in the barrel in response to forces applied to the wire in a direction opposite to the loading direction, the wire extending from the cavity to an exterior of the housing, the mating end of the contact having a tip and a mating interface remote from the tip, the tip engaging the housing, the mating end of the contact including a transition member joined to the wire end of the contact, the mating interface of the mating end of the contact extending along the contact between the tip and the transition member; and a strain relief member extending from the exterior of the housing, the strain relief member configured to engage a portion of the wire upstream from the insertion segment of the wire.

16. The solid state lighting assembly of claim 15, wherein the insertion segment of the wire extends along the cavity axis to the contact, the strain relief member being positioned spaced apart from the cavity such that an intermediate segment of the wire extends between the cavity and the strain relief member at an oblique angle with respect to the cavity axis.

17. The solid state lighting assembly of claim 15, wherein an intermediate segment of the wire extends between the insertion segment of the wire and a main segment of the wire, the strain relief member holding the wire such that the main segment of the wire extends from the intermediate segment of the wire at an oblique angle.

18. The solid state lighting assembly of claim 15, wherein the strain relief member is a hook that receives the wire such that the wire wraps at least partially around the hook.

19. The solid state lighting assembly of claim 15, wherein the strain relief member is a post, the wire being wrapped at least one time around the post.

20. The solid state lighting assembly of claim 15, wherein the strain relief member includes a series of posts, the wire being threaded through the series of posts such that the wire changes directions between each post.

* * * * *